US011185732B1

(12) United States Patent
Tipple et al.

(10) Patent No.: US 11,185,732 B1
(45) Date of Patent: Nov. 30, 2021

(54) SKI ACCESSORY

(71) Applicant: Whipr, Inc., Wilmington, DE (US)

(72) Inventors: Luke Tipple, Oceanside, CA (US); Tiziano Cousineau, Toronto (CA); David Riley, Markham (CA)

(73) Assignee: WHIPR, INC., Wilmington, DE (US)

( * ) Notice: Subject to any disclaimer, the term of this patent is extended or adjusted under 35 U.S.C. 154(b) by 0 days.

(21) Appl. No.: 17/191,609

(22) Filed: Mar. 3, 2021

Related U.S. Application Data

(63) Continuation-in-part of application No. 17/086,122, filed on Oct. 30, 2020, now Pat. No. 11,154,745.

(60) Provisional application No. 63/045,553, filed on Jun. 29, 2020.

(51) Int. Cl.

| | |
|---|---|
| ***A63B 21/00*** | (2006.01) |
| *A63B 23/12* | (2006.01) |
| *A63B 23/035* | (2006.01) |
| *A63B 21/16* | (2006.01) |

(52) U.S. Cl.
CPC ..... *A63B 21/151* (2013.01); *A63B 21/154* (2013.01); *A63B 21/15* (2013.01); *A63B 21/16* (2013.01); *A63B 21/1618* (2013.01); *A63B 23/03533* (2013.01); *A63B 23/1263* (2013.01)

(58) Field of Classification Search
None
See application file for complete search history.

(56) References Cited

U.S. PATENT DOCUMENTS 848,272 A * 3/1907 Thornley ..... A63B 21/063 482/102
2,959,414 A * 11/1960 Saltz ..... A63B 21/153 482/127
3,162,441 A * 12/1964 Karlik ..... A63B 21/156 482/124
4,402,504 A * 9/1983 Christian ..... A63B 21/06 482/103
4,685,670 A * 8/1987 Zinkin ..... A63B 21/0552 482/129
4,961,573 A * 10/1990 Wehrell ..... A63B 21/0552 482/124
5,468,205 A * 11/1995 McFall ..... A63B 21/0552 482/121
5,795,274 A 8/1998 Kasbohm
5,820,519 A * 10/1998 Slenker ..... A63B 21/015 482/4
5,820,529 A * 10/1998 Weintraub ..... A63B 21/155 482/92
5,984,844 A * 11/1999 Royer ..... A63B 21/0552 482/121

(Continued)

*Primary Examiner* — Joshua Lee

(57) ABSTRACT

A portable ski accessory that converts a portable resistance device into a ski-type exercise machine is presented. The ski accessory contains a hanger chassis, a mounting element, a track, a cord, a handle, and a connection element. The hanger chassis contains a cord input portion and a cord output portion. The cord input portion is positioned terminally opposite to the cord output portion along the hanger chassis. The mounting element is connected adjacent to the hanger chassis. The track is positioned within the hanger chassis. The track traverses from the cord input portion to the cord output portion. The cord traverses through the track. The handle is connected to the cord. The connection element is connected to the cord, opposite to the handle.

7 Claims, 5 Drawing Sheets

(56) References Cited

U.S. PATENT DOCUMENTS 6,015,371 A * 1/2000 Davitt ..... A63B 21/0552 428/121
6,280,365 B1 * 8/2001 Weber ..... A63B 21/018 482/124
6,315,701 B1 * 11/2001 Shifferaw ..... A63B 21/00069 482/114
6,328,677 B1 * 12/2001 Drapeau ..... A63B 22/0076 482/55
6,413,196 B1 * 7/2002 Crowson ..... A63B 21/153 273/317
6,494,817 B2 * 12/2002 Lake ..... A63B 71/0036 482/93
6,612,972 B1 9/2003 Reichard
6,939,269 B2 * 9/2005 Makofsky ..... A63B 21/154 482/10
7,572,212 B2 * 8/2009 Cassidy ..... A63B 21/0603 482/102
7,909,745 B2 * 3/2011 Mills ..... A63B 21/153 482/130
8,485,951 B1 * 7/2013 Adams ..... A63B 21/151 482/129
9,345,942 B2 5/2016 Stevens
10,556,145 B2 2/2020 Chaudhuri
10,888,728 B2 * 1/2021 Carriere ..... A63B 21/154
2010/0173759 A1 * 7/2010 Lalaoua ..... A63B 71/0619 482/121
2013/0035220 A1 * 2/2013 Adams ..... A63B 21/156 482/129
2014/0113779 A1 * 4/2014 Loach ..... A63B 21/00043 482/115
2016/0325132 A1 * 11/2016 Nelson ..... A63B 5/166
2016/0332019 A1 * 11/2016 Rollins ..... A63B 23/0355
2019/0358485 A1 * 11/2019 Chaudhuri ..... A63B 23/03525

* cited by examiner

SKI ACCESSORY

The current application is a continuation-in-part (CIP) application of a U.S. non-provisional application Ser. No. 17/086,122 filed on Oct. 30, 2020. The U.S. non-provisional application Ser. No. 17/086,122 claims a priority to a U.S. provisional application Ser. No. 63/045,553 filed on Jun. 29, 2020.

FIELD OF THE INVENTION

The present invention relates generally to exercising machines More specifically, the present invention is a ski accessory platform configured to connect to a portable resistance device such that it functions an exercise device to perform ski type exercises.

BACKGROUND OF THE INVENTION

Exercise machines are often bulky and heavy pieces of equipment that can make it difficult for active users to easily move around. More particularly, vertical ski exercising machines have a large frame in which a user can sit in to more comfortably perform exercises and to simulate the position assumed when skiing. However, such a machine is not meant for moving to other positions or for travel. Many of these machines are also only capable of a single type of exercise, specifically a rowing motion which can leave a user wanting for a more diverse workout session.

An objective of the present invention is to create a portable ski accessory suited for connecting to a portable resistance device such that the combination of the two makes a ski exercise machine. The ski accessory is easily taken down and packed. The ski accessory is easily deployed and mounted to any suitable mounting implement, such as a door, wall mount, exercise bar, or any other type of mounting implement, such that a user can perform ski exercises.

SUMMARY OF THE INVENTION

The present invention is a ski accessory that converts a portable resistance device into a ski exercise machine. A ski accessory comprises a hanger chassis, a mounting element, a track, a cord, a handle, and a connection element. The hanger chassis comprises a cord input portion and a cord output portion. The cord input portion is positioned terminally opposite to the cord output portion along the hanger chassis. The mounting element is connected adjacent to the hanger chassis. The track is positioned within the hanger chassis. The track traverses from the cord input portion to the cord output portion. The cord traverses through the track. The handle is connected to the cord. The connection element is connected to the cord, opposite to the handle.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

Figure 1:
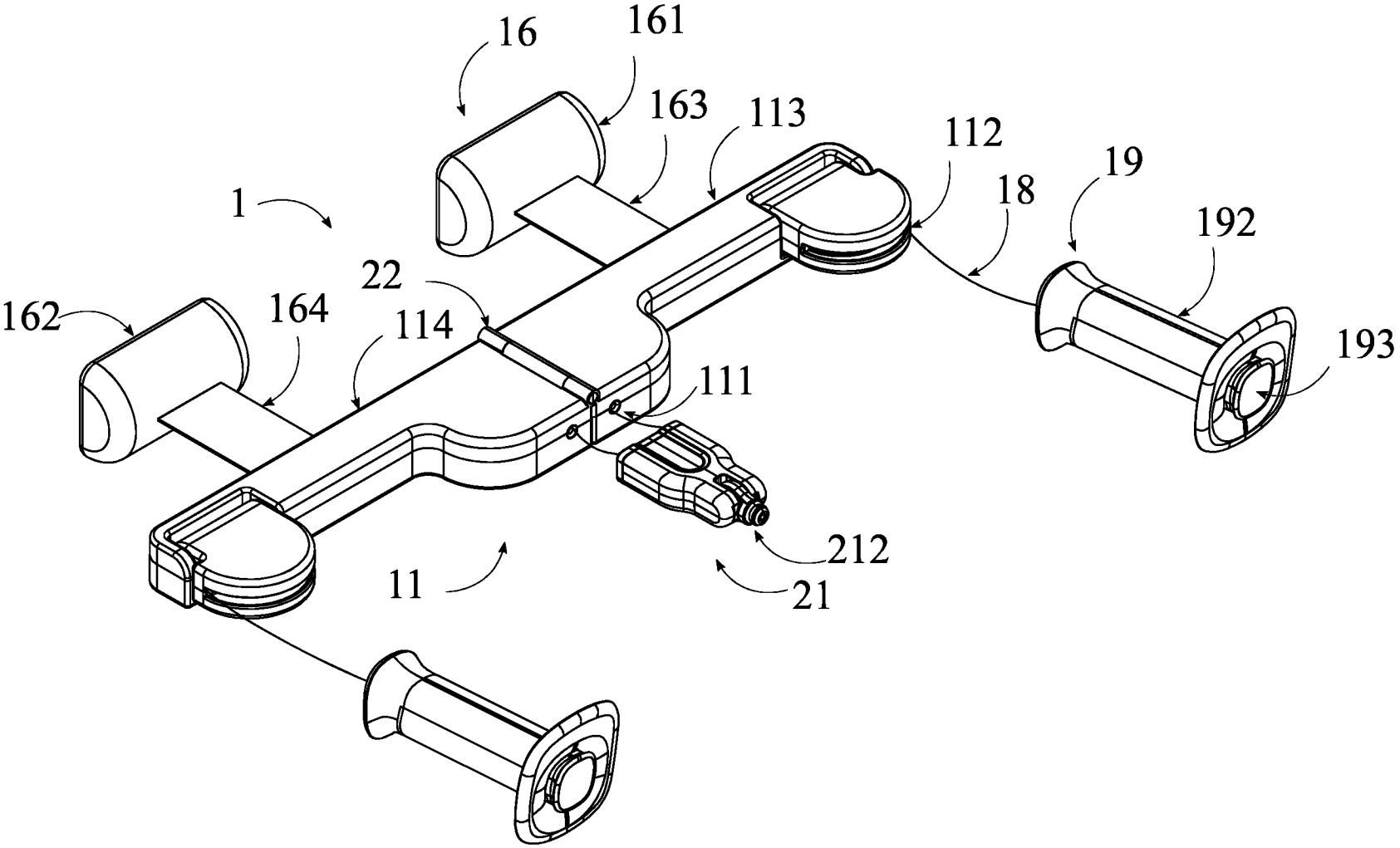
FIG. 1 is a top perspective view of the present invention.
Figure 2:
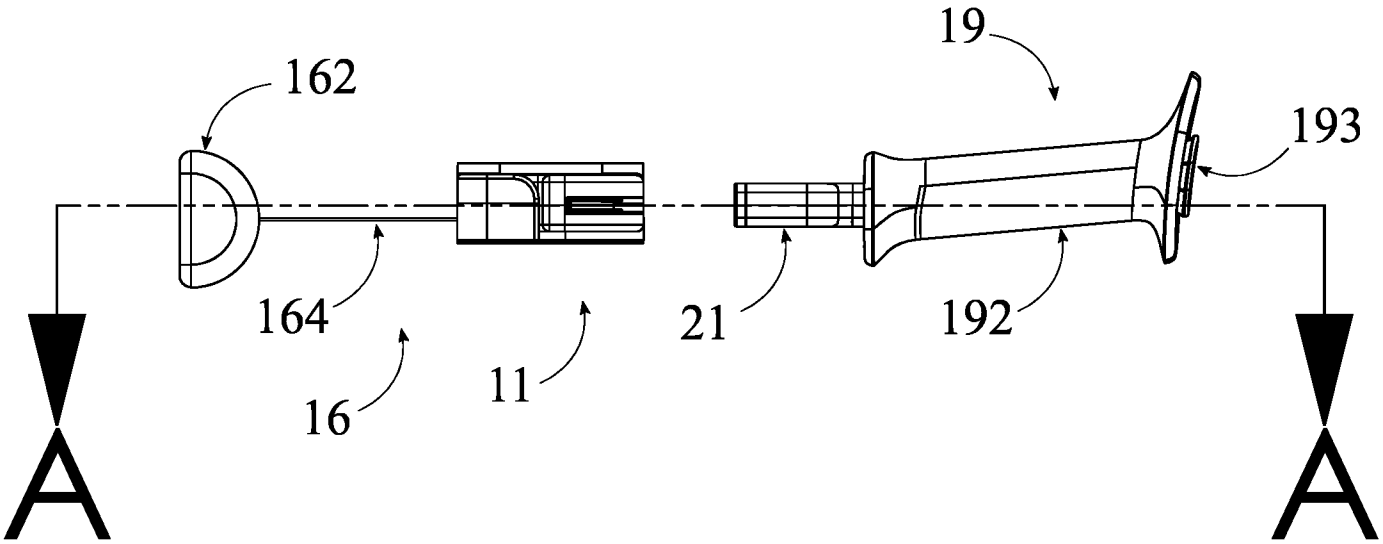
FIG. 2 is a front view of the present invention.
Figure 3:
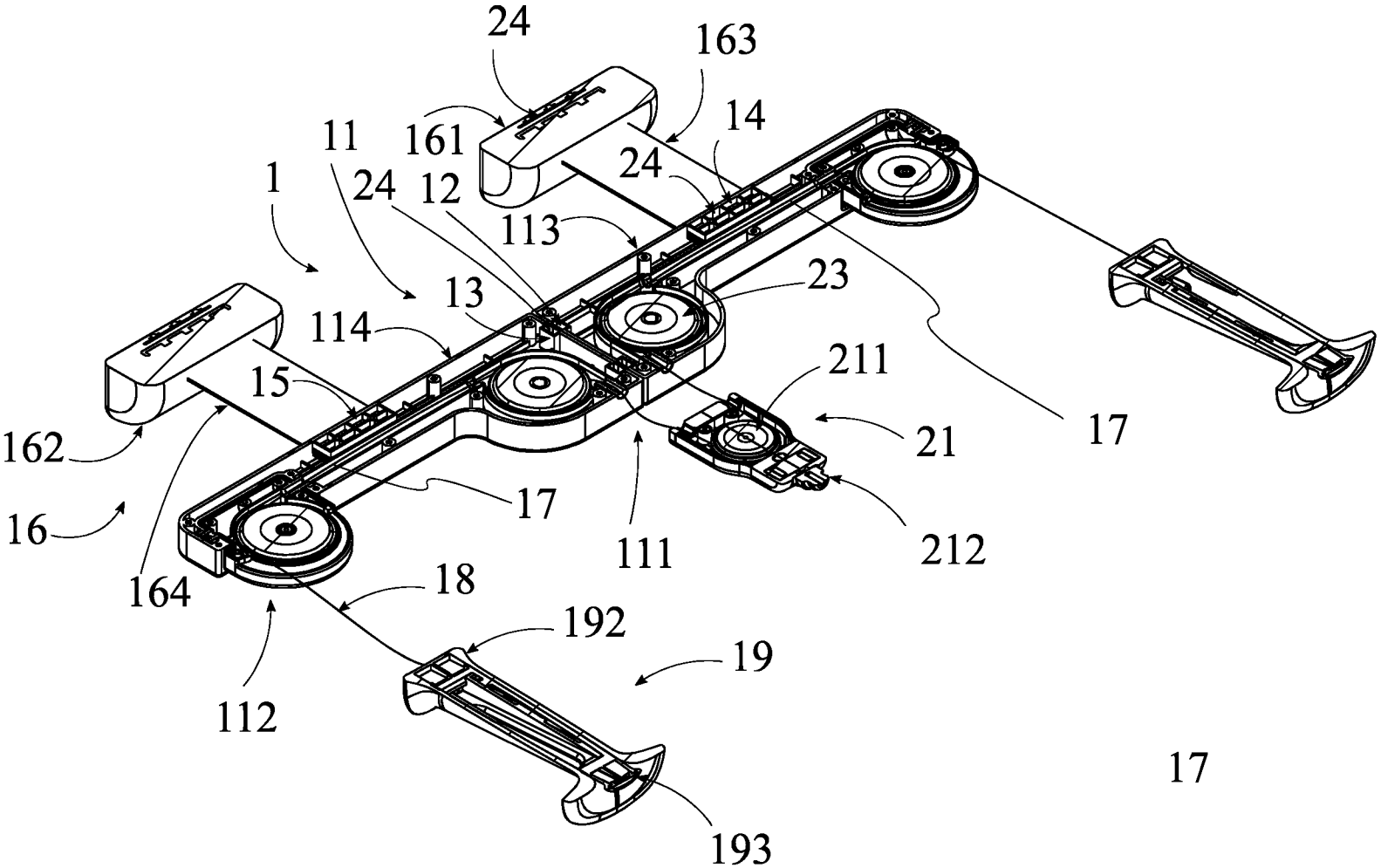
FIG. 3 is a section view of the present invention taken along cutting line A-A in FIG. 2.

The present invention is a ski accessory 1 that converts a portable resistance device into a ski exercise machine. The ski accessory 1 comprises a hanger chassis 11, a mounting element 16, a track 17, a cord 18, a handle 19, and a connection element 21, as shown in FIGS. 1-3. The hanger chassis 11 comprises a cord input portion 111 and a cord output portion 112, as shown in FIGS. 1 and 3. The cord input portion 111 is positioned terminally opposite to the cord output portion 112 along the hanger chassis 11. The mounting element 16 is connected adjacent to the hanger chassis 11. The track 17 is positioned within the hanger chassis 11. The track 17 traverses from the cord input portion 111 to the cord output portion 112. The cord 18 traverses through the track 17. The handle 19 is connected to the cord 18. The connection element 21 is connected to the cord 18, opposite to the handle 19. In the preferred embodiment of the present invention, the ski accessory 1 is made out of a durable and lightweight material, such as, but not limited to plastic, aluminum, carbon fiber, or any other suitable material. In the preferred embodiment of the present invention, the mounting element 16 may take the form of a door jamb type mount element that hoists the ski accessory 1 to the top part of a door frame. In various embodiments, the mounting element 16 may take the form of any other suitable hoisting implement, such as, but not limited to, ties, clips, wall hangers, or any other suitable hoisting implement.

The ski accessory 1 further comprises at least one pulley 23, as shown in FIG. 3. At least one pulley 23 is connected adjacent to the cord input portion 111 and the cord output portion 112. The cord 18 is rollably engaged with the at least one pulley 23 along the track 17. In the preferred embodiment of the present invention, the at least one pulley 23 allows the cord 18 to smoothly glide along the track 17 within the hanger chassis 11. The hanger chassis 11 further comprises a first half 113 and a second half 114, as shown in FIGS. 1-3. The first half 113 and the second half 114 are hingedly connected to each other through a hinge 22 element. In the preferred embodiment of the present invention, the hanger chassis 11 is foldable, such that the first half 113 and the second half 114 are folded together along the hinge 22. When folded, the hanger chassis 11 size is reduced to half, facilitating easier packing.

The ski accessory 1 further comprises at least one magnet insert 24, as shown in FIG. 3. The hanger chassis 11 comprises a first magnet receiving cavity 12 and a second magnet receiving cavity 13, as shown in FIG. 3. The first magnet receiving cavity 12 is positioned within the first half 113. The first magnet receiving cavity 12 is positioned adjacent to the hinge 22 element. The second magnet receiving cavity 13 is positioned within the second half 114. The second magnet receiving cavity 13 is positioned adjacent to the hinge 22. The at least one magnet insert 24 is distributed about the first magnet receiving cavity 12 and the second magnet receiving cavity 13, where the at least one magnet insert 24 is configured to magnetically conjoin the first half 113 to the second half 114 in a deployed configuration, as shown in FIG. 1. The hanger chassis 11 further comprises a third magnet receiving cavity 14 and a fourth magnet receiving cavity 15, as shown in FIG. 3. The third magnet receiving cavity 14 is positioned within the first half 113. The fourth magnet receiving cavity 15 is positioned within the second half 114. The at least one magnet insert 24 is distributed about the third magnet receiving cavity 14 and the fourth magnet receiving cavity 15, where the at least one magnet insert 24 is configured to magnetically conjoin the first half 113 to the second half 114 in a folded configuration.

The mounting element 16 comprises a first anchor 161, a second anchor 162, a first strap 163, and a second strap 164, as shown in FIGS. 1-3. The first strap 163 is connected adjacent to the first half 113. The first anchor 161 is connected adjacent to the first strap 163, opposite to the first half 113. The second strap 164 is connected adjacent to the second half 114. The second anchor 162 is connected adjacent to the second strap 164, opposite to the first half 113.

Figure 4:
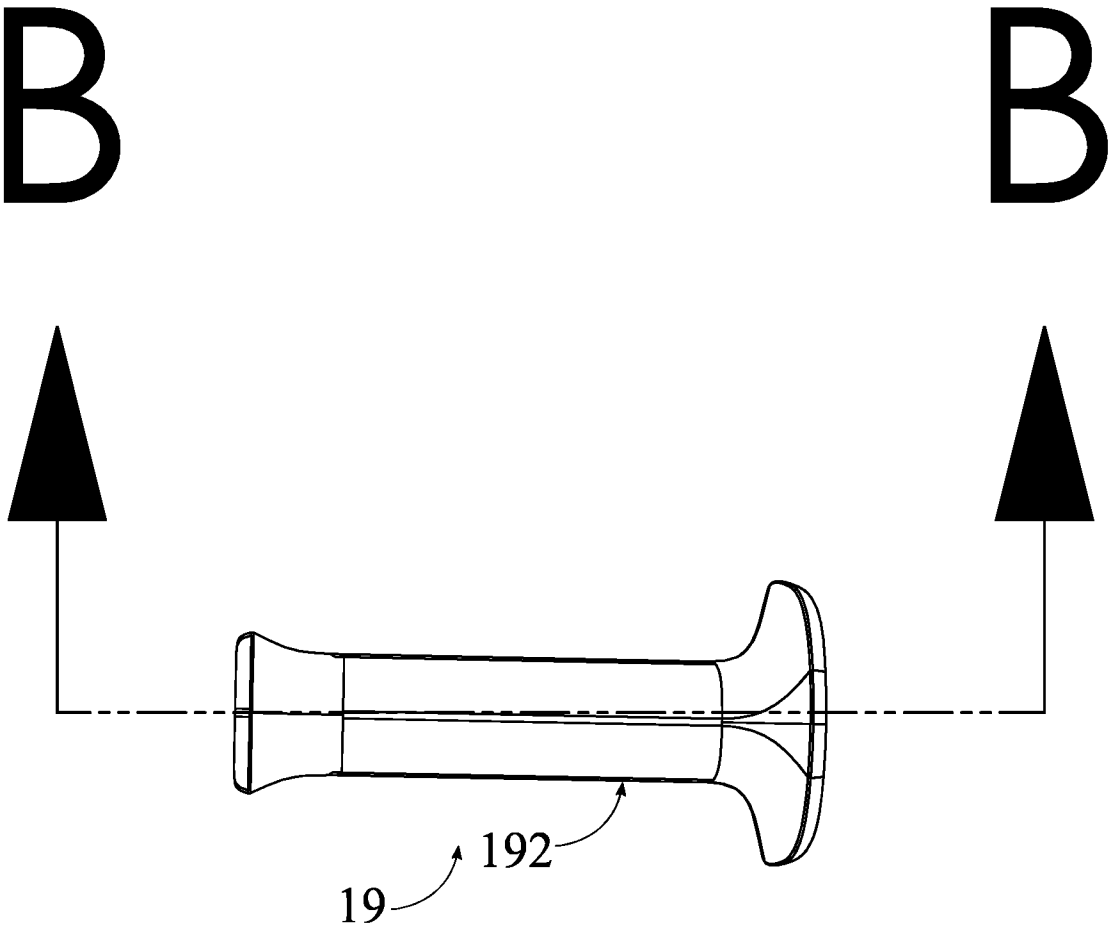
FIG. 4 is a front view of a handle used in the present invention.
Figure 5:
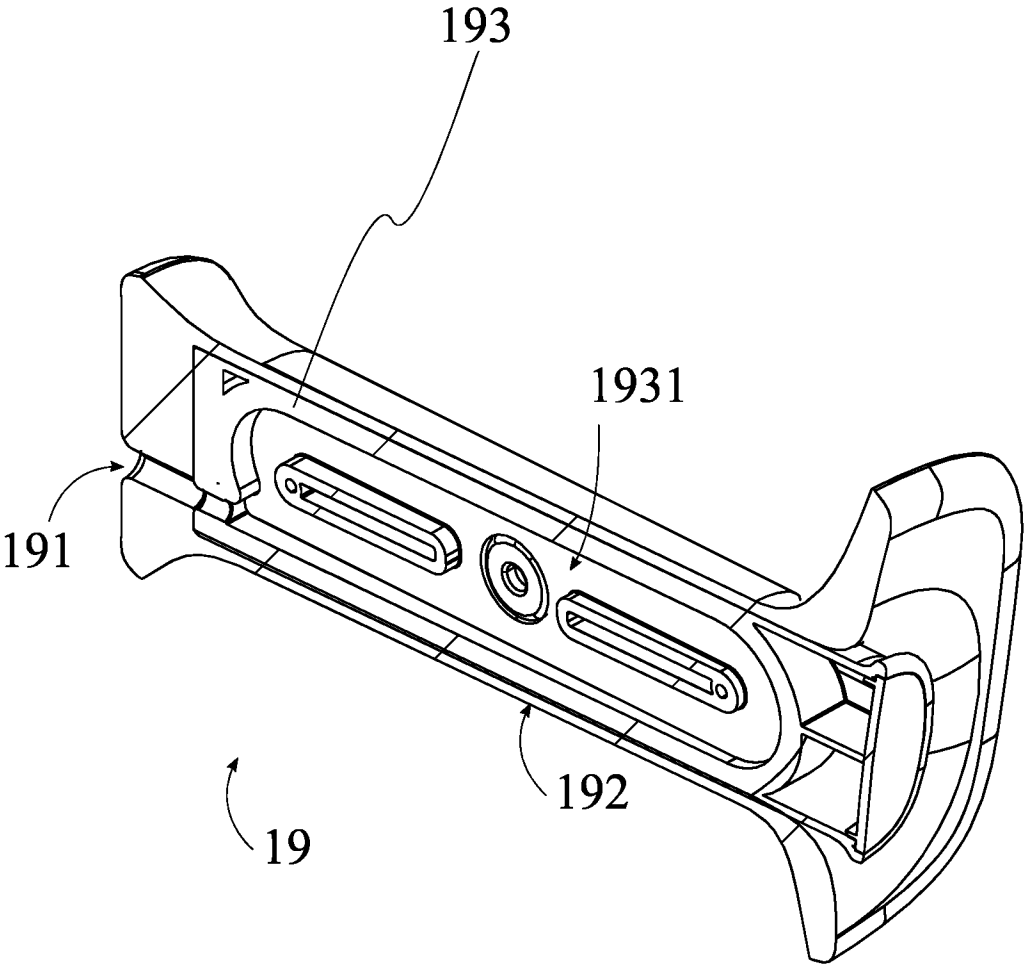
FIG. 5 is a section view of the handle used in the present invention taken along cutting line B-B in FIG. 4.

The at least one magnet insert 24 is connected within the first anchor 161 and the second anchor 162. The first anchor 161 and the second anchor 162 are magnetically attached to each other through the at least one magnet insert 24. This allows first anchor 161 and the second anchor 162 to attach on to each other in the folded configuration. The handle 19 comprises a cord aperture 191, a handle housing 192, a cord compartment 1931, and an adjustment element 193, as shown in FIGS. 4-5. The cord compartment 1931 is longitudinally positioned within the adjustment element 193. The cord aperture 191 traverses through the handle housing 192 to the adjustment element and into the cord compartment 1931. The adjustment element 193 is connected within the handle 19, where the adjustment element 193 is configured to adjust the cord 18 in length. The connection element 21 comprises a connection pulley 211 and a connector 212, as shown in FIG. 3. The connection pulley 211 is connected within the connection element 21. The connection pulley 211 is rollably engaged to the cord 18. The connector 212 is positioned opposite to the connection pulley 211, where the connector 212 is configured to removably attach the portable resistance device.

Although the invention has been explained in relation to its preferred embodiment, it is to be understood that many other possible modifications and variations can be made without departing from the spirit and scope of the invention as hereinafter claimed.

What is claimed is:

1. A ski accessory comprising:
a hanger chassis;
a mounting element;
a track;
a cord;
a handle;
a connection element;
at least one magnet insert;
the hanger chassis comprising a cord input portion and a cord output portion;
the cord input portion being positioned terminally opposite to the cord output portion along the hanger chassis;
the mounting element being connected adjacent to the hanger chassis;
the track being positioned within the hanger chassis;
the track traversing from the cord input portion to the cord output portion;
the cord traversing through the track;
the handle being connected to the cord;
the connection element being connected to the cord, opposite to the handle;
the hanger chassis comprising a first half, a second half, a third magnet receiving cavity, and a fourth magnet receiving cavity;
the first half and the second half being hingedly connected to each other through a hinge element;
the third magnet receiving cavity being positioned within the first half;
the fourth magnet receiving cavity being positioned within the second half; and
the at least one magnet insert being distributed about the third magnet receiving cavity and the fourth magnet receiving cavity, wherein the at least one magnet insert is configured to magnetically conjoin the first half to the second half in a folded configuration.

2. The ski accessory, as claimed in claim 1, comprising:
at least one pulley;
at least one pulley being connected adjacent to the cord input portion and the cord output portion; and
the cord being rollably engaged with the at least one pulley along the track.

3. The ski accessory, as claimed in claim 1, comprising:
at least one magnet insert;
the hanger chassis comprising a first magnet receiving cavity and a second magnet receiving cavity;
the first magnet receiving cavity being positioned within the first half;
the first magnet receiving cavity being positioned adjacent to the hinge;
the second magnet receiving cavity being positioned within the second half;
the second magnet receiving cavity being positioned adjacent to the hinge element; and
the at least one magnet insert being distributed about the first magnet receiving cavity and the second magnet receiving cavity, wherein the at least one magnet insert is configured to magnetically conjoin the first half to the second half in a deployed configuration.

4. The ski accessory, as claimed in claim 1, comprising:
the mounting element comprising a first anchor, a second anchor, a first strap, and a second strap;
the first strap being connected adjacent to the first half;
the first anchor being connected adjacent to the first strap, opposite to the second half;
the second strap being connected adjacent to the second half; and
the second anchor being connected adjacent to the second strap, opposite to the first half.

5. The ski accessory, as claimed in claim 4, comprising:
at least one magnet insert; and
the at least one magnet insert being connected within the first anchor and the second anchor;
the first anchor and the second anchor being magnetically attached to each other through the at least one magnet insert.

6. The ski accessory, as claimed in claim 1, comprising:
the handle comprising a cord aperture, a handle housing, a cord compartment, and an adjustment element;
the cord compartment being longitudinally positioned within the adjustment element;
the cord aperture traversing through the handle housing and into the cord compartment; and
the adjustment element being mounted within the handle.

7. The ski accessory, as claimed in claim 1, comprising:

the connection element comprising a connection pulley and a connector;

the connection pulley being connected within the connection element;

the connection pulley being rollably engaged to the cord; and the connector being positioned opposite to the connection pulley, wherein the connector is configured to removably attach a portable resistance device.

* * * * *